US008621693B2

(12) United States Patent
Wyatt et al.

(10) Patent No.: US 8,621,693 B2
(45) Date of Patent: Jan. 7, 2014

(54) NODAL MODULAR SUPPORT SURFACE

(75) Inventors: Charles Curtis Wyatt, Corona, CA (US); Kenneth Scott Siegner, Calimesa, CA (US); Lydia B. Biggie, Lighthouse Point, FL (US)

(73) Assignee: Anodyne Medical Device, Inc., Los Angeles, CA (US)

( * ) Notice: Subject to any disclaimer, the term of this patent is extended or adjusted under 35 U.S.C. 154(b) by 987 days.

(21) Appl. No.: 11/866,602

(22) Filed: Oct. 3, 2007

(65) Prior Publication Data

US 2008/0078033 A1 Apr. 3, 2008

Related U.S. Application Data

(60) Provisional application No. 60/828,061, filed on Oct. 3, 2006.

(51) Int. Cl.
*A47C 27/08* (2006.01)

(52) U.S. Cl.
USPC ..... 5/713; 5/706; 5/709; 5/710; 5/654; 5/726

(58) Field of Classification Search
USPC ..... 5/706, 710, 709, 713, 654, 726
See application file for complete search history.

(56) References Cited

U.S. PATENT DOCUMENTS

| | | | | |
|---|---|---|---|---|
| 4,852,195 | A * | 8/1989 | Schulman | 5/713 |
| 6,317,909 | B1 * | 11/2001 | Blum | 5/654 |
| 6,591,437 | B1 * | 7/2003 | Phillips | 5/713 |
| 6,671,911 | B1 * | 1/2004 | Hill et al. | 5/713 |
| 2003/0167572 | A1 * | 9/2003 | Mileti | 5/706 |
| 2006/0085919 | A1 * | 4/2006 | Kramer et al. | 5/713 |

* cited by examiner

*Primary Examiner* — Robert G Santos
*Assistant Examiner* — David E Sosnowski
(74) *Attorney, Agent, or Firm* — Nixon & Vanderhye P.C.

(57) ABSTRACT

A support surface includes a plurality of interconnected node groups, where each node group includes at least two nodes connected by a fluid passage. The plurality of interconnected node groups define a node array. A source of pressurized fluid, such as pressurized air is connected with the node array.

11 Claims, 3 Drawing Sheets

NODAL MODULAR SUPPORT SURFACE

CROSS-REFERENCES TO RELATED APPLICATIONS

This application claims the benefit of U.S. Provisional Patent Application Ser. No. 60/828,061, filed Oct. 3, 2006, the entire content of which is herein incorporated by reference.

STATEMENT REGARDING FEDERALLY SPONSORED RESEARCH OR DEVELOPMENT (NOT APPLICABLE)

TECHNICAL FIELD

The present invention relates to alternating pressure support surfaces and, more particularly, to alternating pressure specialty mattresses that provide pressure to only a portion of a body's surface at a time by dynamically varying pressure in discrete compartmented cells of the mattress. The support surface prevents tenting and over-depression, while simultaneously controlling support surface temperature.

BACKGROUND OF THE INVENTION

There are innumerable illnesses and injuries that result in the need for extended bed rest by patients and invalids. Unfortunately, while bed rest is often used to facilitate a patient's recovery from illnesses or injuries, an excessive amount of time spent in bed rest often creates other medical problems. In particular, extended bed rest can result in pressure wounds such as decubitus ulcers or bed sores. The pressure wounds are caused by the reduction in blood flow at a particular point on the patient's body. Usually, this is due to excessive pressure at that point, which is caused by continuous uneven support provided by the mattress or support surface on which the patient is laying. As the blood flow is cut off, bed sores can quickly develop and spread at a rapid pace. If not promptly and properly treated, pressure wounds can even result in a greater injury to a patient than the original illness or injury for which the bed rest was taken. As a result, it would be desirable to have a method of eliminating or reducing the likelihood of pressure wounds when a patient is confined to bed rest.

An early attempt to address this problem was initiated by medical practitioners who would attempt to prevent the occurrence of pressure wounds by physically rotating a patient on the patient's bed on a periodic basis. Due to the shortage of personnel at many medical facilities, or to oversight, manual rotation of patients may not always occur at the proper time. Sometimes, it may not occur at all. As a result, even in a facility where the staff is trained and aware of the problems associated with pressure wounds, patients may not receive adequate care in regard to the avoidance of pressure wounds. It would be desirable to have a method of avoiding the need to rely on human action and to automatically avoid pressure wound injuries caused by constant pressure applied to particular areas of a patient's body.

Support surfaces have been developed for a variety of uses in regard to long-term patient care. A support surface's primary function is to relieve or distribute pressure from many areas of the human body. This is done in a variety of ways using air cells, foam, gel, and other materials to design and construct the support surface. For an air support surface, the best pressure relief results when areas or sections of the support surface are deflated (lowered) allowing for pressure relief, while other areas or sections stay inflated supporting the weight of the body. Support surfaces can be used to provide long-term support for patients or invalids.

A common type of inflatable support surface is an alternating pressure support surface. Support surfaces that utilize alternating pressure are used to prevent and cure pressure wounds such as decubitus ulcers and bed sores. In theory, when a patient is placed on this specialty mattress, only a portion of the patient's body has pressure on it at any given time. This is accomplished by inflating one set of cells while a second set of cells is deflated. The inflated cells support the weight of the body while the deflated cells do not provide pressure on the patient's body. As a result, the deflated cells provide pressure relief and thereby encourage blood flow.

Alternating pressure support surfaces typically use a preset time interval to alternate pressure within the cells. This time interval is typically around five minutes. At the end of the preset time interval, the inflated cells will deflate as the deflated cells inflate. This continually changes the pressure points on the body, allowing blood to flow more freely. The improved blood flow helps to prevent pressure wounds from occurring, and also helps pre-existing wounds to heal.

One difficultly in designing a good pressure-relieving surface is maintaining the definition between the inflated and deflated air cells. It is desirable to avoid tenting and over-depression. Tenting is the tendency of the space above the deflated air cell to be partially covered by the adjacent inflated air cells. The body weight on the inflated air cell tends to flatten it out, and thereby intrude upon the open space left by the deflated air cell. Over-depression of the air cell occurs when a weight is applied to one area, which then is depressed, and the depression naturally also pulls on the adjacent air cell material depressing it also. This results in an excessively large depressed area, and not enough area inflated to properly support the body. One way to overcome these two problems is to have many very small independent air cells.

In addition to bed sores caused by pressure problems, there are also situations where properly controlled temperature levels may be important to a patient's well-being. For example, in certain medical settings, such as the operating rooms, there is a desire not only to have a pressure relieving support surface, but also to assist in the temperature control of the body. There is a need to add heat or cold to the area under or on top of the body. This can greatly aid the physician in controlling correct body temperatures required for certain procedures.

Currently, there are devices that are essentially a blanket through which warm air is passed to heat the body. One such device is known by the trade name Bear Hugger™. However, this device is like a blanket placed over the body and interferes with the access to the patient's body during the operation. In addition, large amounts of heated air are required to maintain the blanket temperature, and the operating room tends to heat up. It would be desirable to have a method of controlling a patient's temperature in these situations without the heat and patient access drawbacks associated with prior art devices.

While attempting to address the basic need to prevent the formation of pressure wounds during the healing process, the prior art has failed to provide an alternating pressure support surface that is capable of preventing tenting and over-depression. In addition, the prior art has not provided an efficient method of controlling temperature in the support surface.

BRIEF SUMMARY OF THE INVENTION

A support surface is provided with nodal arrays that are enclosed in a cover. Warm or cool air, or other medium, is passed through a plenum formed by a space between the nodes and the cover. The warm or cool air can be re-circulated, requiring less overall volume of air. The support surface can be heated or cooled by passing a medium, which may be air, through the plenum and between the nodal arrays, while contained in the cover. The interior of the support surface can be foam, and/or other materials such as inflatable compartments, which are modular in construction allowing for a variety of zones in the support surface. The patient is heated or cooled by the support surface because of the air contained within the plenum, the heat rise or loss to the room is reduced, and more heat or cool is passed to the patient's body by conduction.

In an exemplary embodiment, a support surface includes a plurality of interconnected node groups, where each node group includes at least two nodes connected by a fluid passage. The plurality of interconnected node groups define a node array. A source of pressurized fluid, such as pressurized air is connected with the node array. In one arrangement, the source of pressurized fluid is connected with the node array via a manifold such that a fluid pressure in each of the nodes is independently controllable. Alternatively, the source of pressurized fluid is connected with the node array via a manifold such that a fluid pressure in each of the node groups is independently controllable.

The support surface may also include a cover, wherein the node array is disposed in the cover. In this context, a space between the cover and the node array defines a plenum, and the support surface further includes a heating or cooling source in fluid communication with the plenum.

Preferably, a foam insert is disposed in each of the nodes. In this context, the foam insert may be constructed such that upon expansion or retraction by an application of force, the foam insert returns to its original shape upon cessation of the force.

In one arrangement, each node group includes at least three nodes arranged in an offset orientation relative to one another. In this context, the interconnected node groups may be interconnected in a zigzag pattern.

The support surface may additionally include a foam stabilizer including a plurality of openings corresponding to each of the nodes in the node array. The foam stabilizer is coupled with the node array by fitting the openings on the nodes. In one arrangement, the foam stabilizer comprises a top half and a bottom half, and the top half is secured on an upper side of the node array and the bottom half is secured on a lower side of the node array. A supporting pad may additionally be disposed under the bottom half.

In another exemplary embodiment, a support surface includes a plurality of interconnected node groups, where each node group has at least two nodes connected by a fluid passage. The interconnected node groups are assembled in an interlocking geometric arrangement and define a node array. A foam insert is disposed in each of the nodes, and a cover covers the node array.

In still another exemplary embodiment, a method of assembling a support surface includes the steps of (a) connecting top and bottom halves of a plurality of node groups, each node group including at least two nodes connected by a fluid passage; (b) interconnecting the plurality of node groups in an interlocking geometric arrangement to define a node array; and (c) disposing the node array within a cover. The method may further include, prior to step (a), inserting a foam insert into each of the nodes. The top and bottom halves of the plurality of node groups are preferably separately molded, preferably in the same mold.

BRIEF DESCRIPTION OF THE DRAWINGS

These and other aspects and advantages will be described in detail with reference to the accompanying drawings, in which.

DETAILED DESCRIPTION OF A PREFERRED EMBODIMENT

Figure 1:
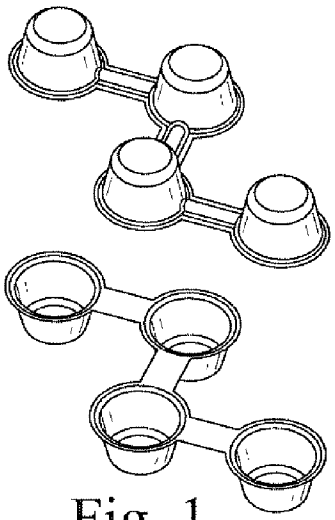
FIG. 1 is an assembly drawing of a first node group including a plurality of nodes.
Figure 2:
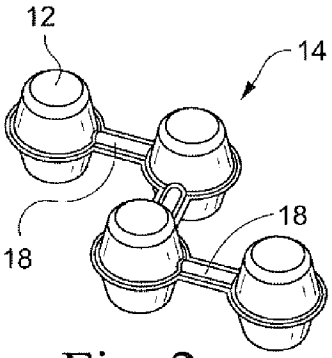
FIG. 2 shows the assembled node group.
Figure 3:
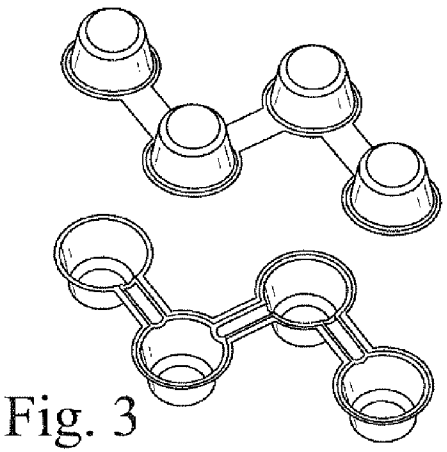
FIG. 3 is an assembly drawing of a second node group.
Figure 4:
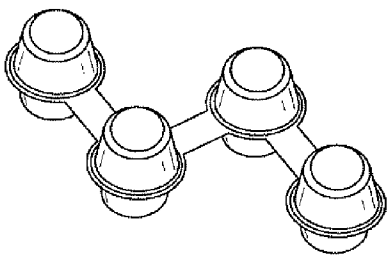
FIG. 4 shows the assembled second node group.

With reference to FIGS. 1-5, a support surface has a number of small air cell nodes 12, each of which, or groups 14 of nodes, can be controlled independently from the adjacent node or group of nodes which together define a nodal array 16. Independent control allows alternating pressure therapy to be provided by the support surface 10. In a preferred embodiment, the node 12 is cylindrical in shape, but those skilled in the art will recognize that the nodes 12 could be other shapes, such as spherical, trapezoidal, etc. In the preferred embodiment, the nodes 12 are approximately 1.5" in diameter and approximately 2" high. However, larger or smaller nodes 12 could be used. Each node 12 has a connecting fluid passage 18. If each node 12 is controlled separately, the fluid passage 18 is connected to a fluid source, such as air source 20 shown in FIG. 5 via a manifold 22. If node groups 14 are used, the passage 18 connects one node 12 to the next adjacent node etc., with a final passage 18 connecting to the air source 20.

Figure 6:
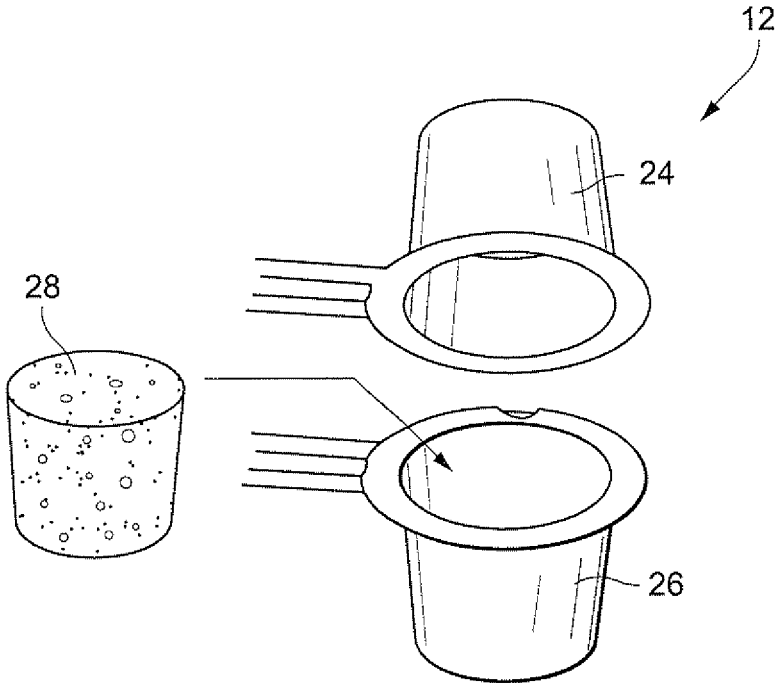
FIG. 6 shows a foam insert for a single node.

As shown in FIG. 6, each node is preferably assembled in halves 24, 26 (discussed in more detail below) and preferably includes a foam insert 28 therein. Any springy material could be used for the foam insert 28. That is, the foam insert 28 is constructed such that with expansion or retraction by an application of force, upon cessation of the force, the foam insert 28 returns to its original shape. Alternatively, without the foam insert 28, the air source 20 could be used to re-inflate the deflated nodes 12. Reticulated or open cell foam is preferred so air can easily pass through it even when depressed.

As shown in FIGS. 1-4, one half of the node groups 14 is formed with a flat connector between the nodes 12 while the other half includes a connector having a concave channel. When assembled, the concave channel defines the fluid passage 18.

Figure 5:
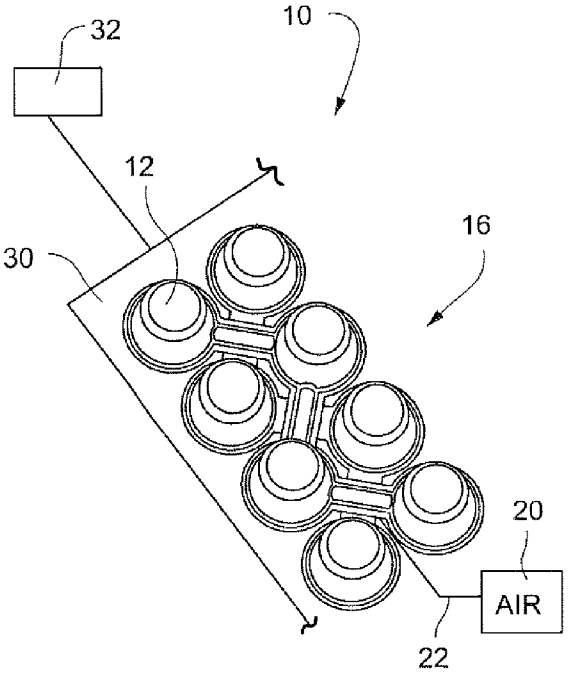
FIG. 5 illustrates an exemplary node array including interconnected first and second node groups.

The physical configuration of the array 16 is an important feature in the preferred embodiment. For example, if the node array 16 is made up of rectangular blocks or long strips of nodes 12, it would be difficult to achieve maximum design of pressure zones while assuring all the nodes stay positioned and are stable in the support surface 10. In a preferred embodiment, the node groups 14 are formed in various geometrical shapes that have an interlocking feature. That is, one node group 14 interlocks with a second node group 14 to define the nodal array 16. Adjacent nodal arrays 16 may also be interlocked. For example, as shown in FIG. 5, a zigzag shape can be used to interlock one node group 14 with an adjacent node group 14. As shown in FIGS. 1-5, with the node groups 14 interconnected in a zigzag pattern, it is preferable that the flat sides of the connectors are assembled facing each other. Of course, those skilled in the art will realize that any number of configurations can be used in this manner.

This interlocking design allows the support surface 10 to be very modular, in that many zones of unusual shapes can be used with one another. For example, two circles arranged just under the patient's heels could be constructed and controlled independently from the rest of the support surface.

The interlocking feature also makes it possible to have hundreds of small nodes 12 which stay correctly positioned in the support surface 10, without the necessity of fixing each node 12 to the support surface 10.

In a preferred arrangement, the node array 16 is disposed in a cover 30 (shown cut away in FIG. 5). A space between the cover 30 and the node array 16 defines a plenum. A support surface 10 may additionally include a heating or cooling source 32 in fluid communication with the plenum. In this manner, a patient supported on the support surface 10 can be kept warm or cool by controlling a temperature of the air contained within the plenum. Preferably, the cover 30 is constructed to contain the air in the plenum, but is also waterproof and vapor permeable. If the heating or cooling feature is included, it would not be ideal for the cover to be formed of a loose woven material, although such a material may be suitable without the heating or cooling structure.

Figure 8:
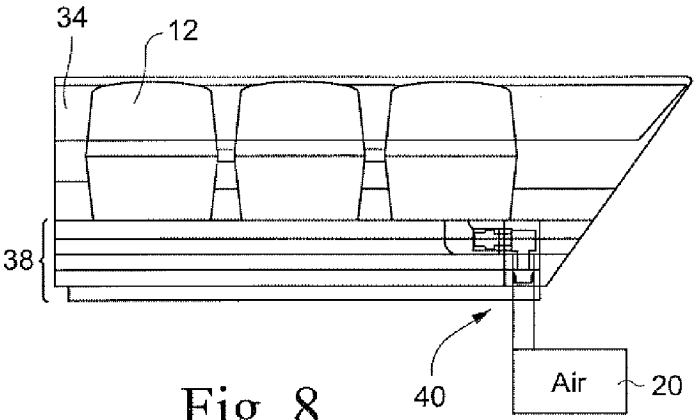
FIG. 8 is a side view of the support surface illustrated in FIG. 7.
Figure 7:
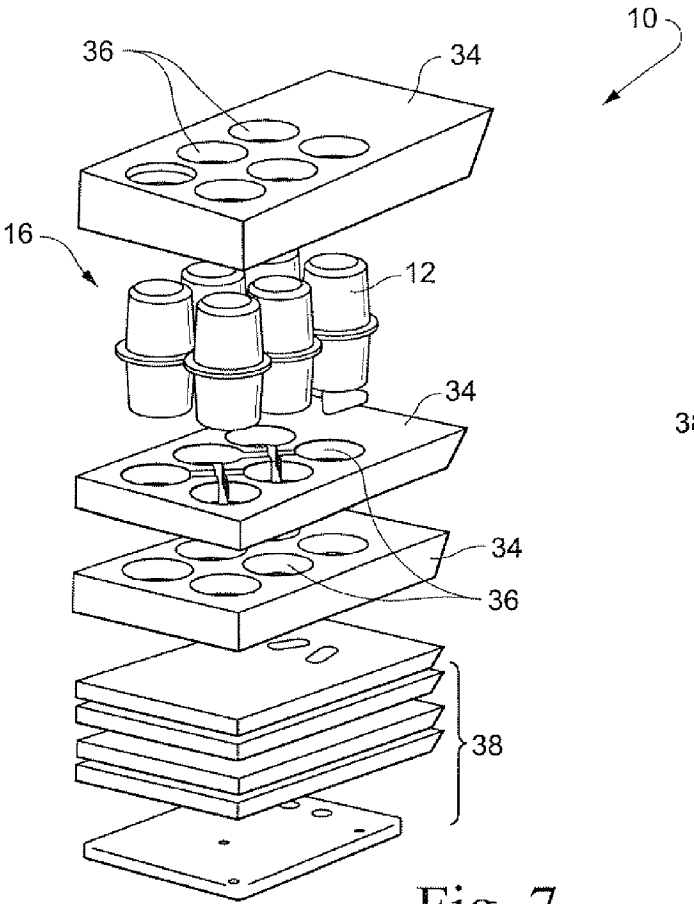
FIG. 7 illustrates an exemplary alternative construction for the support surface.

The nodal arrays 16 may be assembled in simple rectangular or linear shapes arrays, while an exterior foam serves to keep the shape stabilized. The interlocked node groups 14 described above may also be used with the exterior foam. FIGS. 7 and 8 show an alternative construction of the support surface. In this embodiment, the support surface 10 includes a foam stabilizer 34, which may comprise multiple parts as shown in FIG. 7. The foam stabilizer 34 includes a plurality of openings 36 corresponding to each of the nodes 12 in the node array 16. The foam stabilizer 34 is coupled with the node array 16 by fitting the openings 36 on the nodes 12. A support pad 38 including one or multiple layers may be disposed under a bottom portion of the foam stabilizer 34 to provide added support to the patient and to prevent the support surface 10 from bottoming out. As shown in FIG. 8, the node array 16 may be coupled with an air source 20 via suitable tubing 40 and the like.

In the preferred embodiment, there are a variety of ways to control the inflation and deflation of the nodes 12 to promote effective pressure relief. Air pressure can be maintained in some nodes 12 to support the patient. The deflated nodes 12, for pressure relief, can be rapidly deflated using a vacuum (by reversing the air source 20). Once the vacuum pressure is released, the foam insert 28 would automatically "re-inflate" the node 12. Different densities or firmness of foam could be used in the nodes 12 in various areas of the support surface 10. For example, a more dense foam may be used under the torso, in order to support the torso due to the greater weight in that part of the body, while a less dense foam could be used under the heels or head.

The individual nodes 12 or the nodal groups 14 can be manufactured in a variety of ways. For example, the node groups 14 can be fabricated from nylon with urethane or vinyl. During assembly, the node groups 14 can be RF welded or heat sealed into the specified shape. With continued reference to FIGS. 1-5, in a preferred embodiment, unsupported urethane is pre-deformed by vacuum forming or other methods into one half of the node. Urethane is suitable because it is flexible, so it will deform when a force is applied. Those skilled in the art will recognize that numerous other materials may be alternatively used. The top half and the bottom half are preferably identical so just one shape is required to be made. The two pieces are attached by RF welding or the like together with bottom piece facing up, and the top piece facing down. Those skilled in the art will realize that there are several methods which may be used to attach the top half and bottom half together, such as glue, adhesive, RF welding, heat sealing, etc. Before attachment, the foam insert 28 is inserted into the node cavity. The result is an airtight node 12 with foam insert 28, and with the connecting air passage 18. The whole node 12, both top and bottom together could be constructed by blow molding or other suitable methods.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims. For example, the material used to construct the alternating pressure support surface may be any material suitable for its purpose, the size, shape, and number of the nodes can vary, etc.

The invention claimed is:

1. A support surface comprising:

a plurality of interconnected node groups, each node group including at least three nodes connected by a connector and arranged in an offset orientation relative to one another, wherein each node includes an internal space, and wherein a foam insert is disposed in the internal space of at least some of the nodes, the plurality of interconnected node groups being interconnected in a zigzag pattern and defining a node array, wherein the nodes in the node array are spaced from one another; and a source of pressurized fluid connected with the node array and operable to supply negative pressure to the nodes;

wherein the foam insert is constructed such that upon retraction of the node and respective foam insert by an application of the negative pressure from the source of pressurized fluid, the foam insert returns the node to its original shape upon cessation of the negative pressure.

2. A support surface according to claim 1, wherein the connector is a fluid passage, and wherein the source of pressurized fluid is connected with the node array via a manifold such that a fluid pressure in each of the node groups is independently controllable.

3. A support surface according to claim 1, further comprising a cover, wherein the node array is disposed in the cover.

4. A support surface according to claim 3, wherein a space between the cover and the node array defines a plenum, the support surface further comprising a heating or cooling source in fluid communication with the plenum.

5. A support surface according to claim 1, wherein the source of pressurized fluid comprises a source of pressurized air.

6. A support surface according to claim 1, wherein each of the nodes comprises node halves, each node half including a flange securing facing node halves to each other, the flanges having a larger perimeter than a perimeter of the nodes to thereby define a spacer between the nodes.

7. A support surface comprising:

a plurality of interconnected node groups, each node group including at least three nodes connected by a connector and arranged in an offset orientation relative to one another, wherein each node includes a top half connected to a bottom half and defining an internal space, the interconnected node groups being assembled in an interlocking geometric zigzag pattern arrangement and defining a node array, wherein the nodes in the node array are spaced from one another;

a foam insert disposed in the internal space of each of the nodes; and a cover in which the node array is disposed, wherein the foam insert is constructed such that upon retraction of one of the nodes by an application of force, the foam insert returns the one of the nodes to its original shape upon cessation of the force.

8. A support surface according to claim 7, further comprising a source of pressurized fluid connected with the node array.

9. A support surface according to claim 7, wherein the connector is a fluid passage, and wherein the source of pressurized fluid is connected with the node array via a manifold such that a fluid pressure in each of the node groups is independently controllable.

10. A support surface according to claim 7, wherein a space between the cover and the node array defines a plenum, the support surface further comprising a heating or cooling source in fluid communication with the plenum.

11. A support surface according to claim 7, wherein each node half comprises a flange securing respective top and bottom halves of each node, the flanges having a larger perimeter than a perimeter of the nodes to thereby define a spacer between the nodes.

* * * * *